US008374715B2

(12) United States Patent
Lofgren et al.

(10) Patent No.: US 8,374,715 B2
(45) Date of Patent: Feb. 12, 2013

(54) MODE BASED METAL STRIP STABILIZER

(75) Inventors: Peter Lofgren, Vasteras (SE); Mats Molander, Vasteras (SE)

(73) Assignee: ABB Research Ltd. (CH)

( * ) Notice: Subject to any disclaimer, the term of this patent is extended or adjusted under 35 U.S.C. 154(b) by 228 days.

(21) Appl. No.: 12/714,886

(22) Filed: Mar. 1, 2010

(65) Prior Publication Data

US 2010/0161104 A1 Jun. 24, 2010

Related U.S. Application Data

(63) Continuation of application No. PCT/EP2007/059189, filed on Sep. 3, 2007.

(51) Int. Cl.
*G06F 19/00* (2011.01)

(52) U.S. Cl. ..... 700/150; 700/154; 700/155

(58) Field of Classification Search ..... 700/148, 700/150, 154–156
See application file for complete search history.

(56) References Cited

U.S. PATENT DOCUMENTS 5,467,655 A * 11/1995 Hyoguchi et al. ..... 73/579
6,158,260 A * 12/2000 Ginzburg ..... 72/9.1
6,471,153 B1 10/2002 Kimura et al.

FOREIGN PATENT DOCUMENTS

JP 10298727 A 11/1998
JP 2000345310 A 12/2000
WO 0111101 A1 2/2001
WO 2006101446 A1 9/2006

OTHER PUBLICATIONS

International Search Report and Written Opinion of the International Searching Authority; PCT/EP2007/059189; Jan. 10, 2008; 8 pages.

* cited by examiner

*Primary Examiner* — Sean Shechtman

(74) *Attorney, Agent, or Firm* — St. Onge Steward Johnston & Reens LLC

(57) ABSTRACT

A method for vibration damping and shape control of a suspended metal strip during continuous transport in a processing facility in a steel rolling line or surface treating line in a steel mill, where the method comprises the steps: measuring distance to the strip by a plurality of non-contact sensors; and generating a strip profile from distance measurements; decomposing the strip profile to a combination of mode shapes; determining coefficients for the contribution from each mode shape to the total strip profile; and controlling the strip profile by a plurality of non-contact actuators based on a combination of mode shapes.

15 Claims, 5 Drawing Sheets

MODE BASED METAL STRIP STABILIZER

CROSS-REFERENCE TO RELATED APPLICATIONS

The present application is a continuation of pending International patent application PCT/EP2007/059189 filed on Sep. 3, 2007 which designates the United States, the content of which is incorporated herein by reference.

FIELD OF THE INVENTION

The present invention relates to a method and system for stabilizing and controlling the vibrations or shape of a metal strip or an elongated steel sheet or strip driven along the running surface of a processing facility in a steel rolling line or surface treating line in a steel mill.

BACKGROUND OF THE INVENTION

In the steel industry there is a need to stabilize i.e. reduce unwanted motions and vibrations of moving metal strips or sheets. The stabilization is especially important in hot-dip galvanizing lines.

In hot-dip galvanizing lines, the metal strip to be galvanized is moved through a bath of molten zinc. When the metal strip leaves the zinc bath, an air-knife blows off the excess zinc to reduce the thickness of the coating to the desired value. By reducing the vibration of the metal strip, the air-knife action (wiping) can be better controlled and the coating thickness made more uniform. This allows the coating to be made thinner and this saves zinc, reducing the weight of the product and reduces costs.

Vibrations in the galvanizing line originate from imperfections in the line's mechanical components. Vibrations can be accentuated at high line speeds and on longer unsupported or free strip paths. Additional movements and vibrations of the strip originate from air flowing on the strip, both from the air-knifes and cooling air.

WO2006101446A1 (Loefgren et. al.) entitled "A device and a method for stabilizing a steel sheet" present a device for stabilizing an elongated steel sheet which is continuously transported in a transport direction along a predetermined transport path. The device comprises at least a first pair, a second pair and a third pair of electromagnets with at least one electromagnet on each side of the steel sheet, which are adapted to stabilize the steel sheet.

U.S. Pat. No. 6,471,153B1 (TETSUYUKI et. al.) entitled "Vibration control apparatus for steel processing line" relates to an apparatus for controlling vibration of steel sheet being processed in a processing line. The apparatus includes: electromagnet devices for generating magnetic forces acting at right angles on the steel sheet; sensor devices for detecting separation distances between the steel sheet and the electromagnet devices. In U.S. Pat. No. 6,471,153B1 each electromagnet devices is controlled by one measurement by one sensor device. No information from other sensor devices is used to correct or adapt the generated magnetic force from a device.

SUMMARY OF THE INVENTION

It is an object of the present invention to provide a method and system for controlling movement of a steel sheet or strip being processed in a steel processing line, so that the processing line can be operated in a stable manner without having operational problems such as strip vibration, strip movement or strip shape loss (e.g. bending). The system will act as a damper of strip vibration, reducing strip movement and act as a shape controller of the strip.

An embodiment of the present invention is a method for vibration damping and shape control of a suspended metal strip during continuous transport in a processing facility in a steel rolling line or surface treating line in a steel mill where the method comprises the steps of

- measuring distance to the strip by a plurality of non-contact sensors, and
- generating a strip profile from distance measurements
- decomposing the strip profile to combination of mode shapes, and
- determining coefficients for the contribution from each mode shape to the total strip profile, and
- controlling the strip profile by a plurality of non-contact actuators based on a combination of mode shapes.

The distance to the strip is measured from each non-contact sensor giving a number of distances (data points that vary with time) along the strip profile. In one embodiment the sensors are placed on both sides of the strip and in another embodiment the sensors are placed on one side of the strip. The distances can be used for generating a strip profile (e.g. by fitting a spline function or a smoothed spline function to the data points). With time varying distances a time varying strip profile can be determined.

According to an embodiment of the invention, a control means for controlling the actuators is adapted with preprogrammed control functions, comprising one best control function for each mode shape, and the method further comprises the step of; controlling a plurality of actuators by weighing preprogrammed control functions with the coefficients from mode shape decomposition. The weighing of preprogrammed control functions can be done by e.g. filtering the values from the coefficients from mode shape decomposition.

According to an embodiment of the present invention, the mode shapes that the strip profile is decomposed into are natural mode shapes. According to an embodiment of the present invention, the strip profile is decomposed to a linear combination of mode shapes.

According to an embodiment of the invention, the method further comprise the step of adapting the weighing of preprogrammed control functions based on input from process parameters such as strip width and/or strip thickness.

According to an embodiment of the invention, the method is based on using the same number of non-contact sensors as the number of non-contact actuators and in another embodiment of the present invention the number of non-contact sensors is larger than the number of non-contact actuators.

According to an embodiment of the invention, the method comprises the step of adapting the placement of the non-contact sensors to the strip width.

According to an embodiment of the invention, the method further comprises the step of monitoring the coefficients from natural mode shape decomposition.

According to an embodiment of the invention, the method further comprises the step of continuously carrying out a frequency analysis of the coefficients from mode shape decomposition to determine the frequency and size of strip movements.

According to an embodiment of the invention, the method further comprises the step of using the actuators to minimize the variance of the coefficients. Minimizing the variance of the coefficients has the effect of damping vibrations of the strip.

According to an embodiment of the invention, the method further comprises the step of using the actuators to influence the shape of the average profile. Influencing the shape of the average profile is known in the art as shape control of the strip.

Another embodiment of the present invention is a system for vibration damping and/or shape control of a suspended metal strip during continuous transport in a processing facility in a steel rolling line or surface treating line in a steel mill, the system comprises; a plurality of non-contact sensors measuring distance to the metal strip vertical to strip surface, a plurality of non-contact actuators to stabilize said metal strip, and the system further comprises means for determining the strip profile and means for decomposing the determined strip profile into a combination of natural mode shapes and determining coefficients for the contribution from each natural mode shape to the total strip profile, and means for controlling the plurality of actuators based on the combination of natural mode shapes.

According to an embodiment of the invention, the system comprises means for controlling actuators based on a preprogrammed control function for each natural mode shape and the control of the actuators using a combination of control functions weighted by the determined coefficients.

According to an embodiment of the invention, the non-contact sensor measuring the distance to the strip is located in proximity to the non-contact actuator stabilizing the movement of the strip.

According to an embodiment of the invention, the plurality of non-contact sensors measuring the distance is inductive sensors.

According to an embodiment of the invention, the plurality of non-contact actuators stabilizing the movement are electromagnets.

BRIEF DESCRIPTION OF THE DRAWINGS

The drawings constitute a part of this specification and include exemplary embodiments to the invention, which may be embodied in various forms.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
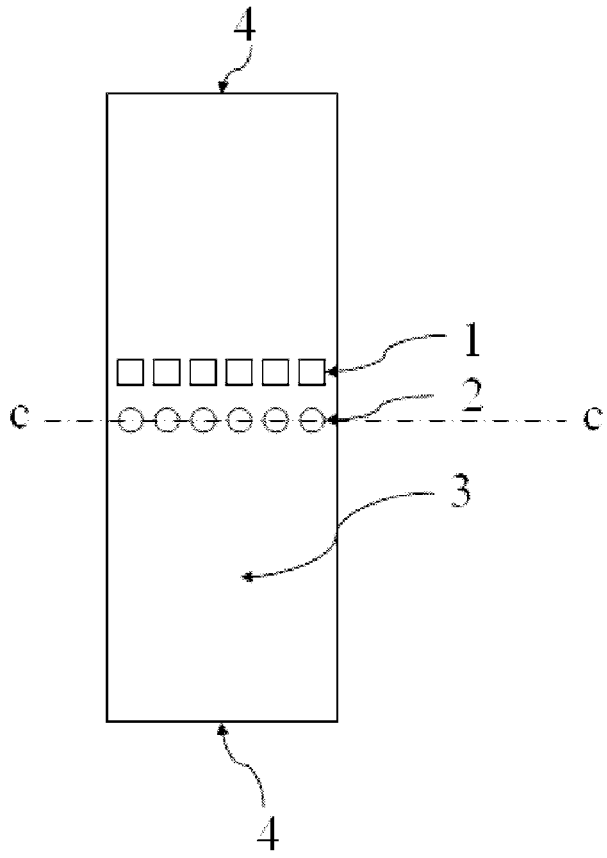
FIG. 1 shows one arrangement of sensors and actuators vertical to the strip surface.

FIG. 1 shows one arrangement of sensors and actuators vertical to the strip 3 surface according to an embodiment of the present invention. The metal strip 3 profile is suspended or fixed at the short side 4. Position sensors 2, which could be inductive position sensors, and actuators 1, which could be electromagnets, are arranged across the strip. The electromagnets are generating magnetic forces acting at right angles on the metal strip and by controlling the current to the electromagnets the force on the metal strip can be controlled. There must be at least as many sensors 2 as there are actuators 1. The actuators 1 apply a force on the strip to keep it in position. The sensors are located on the same cross-section (or close enough to be considered measuring the same profile) as the force generating actuators 1. The line c-c is where the strip profile is determined.

Figure 2:
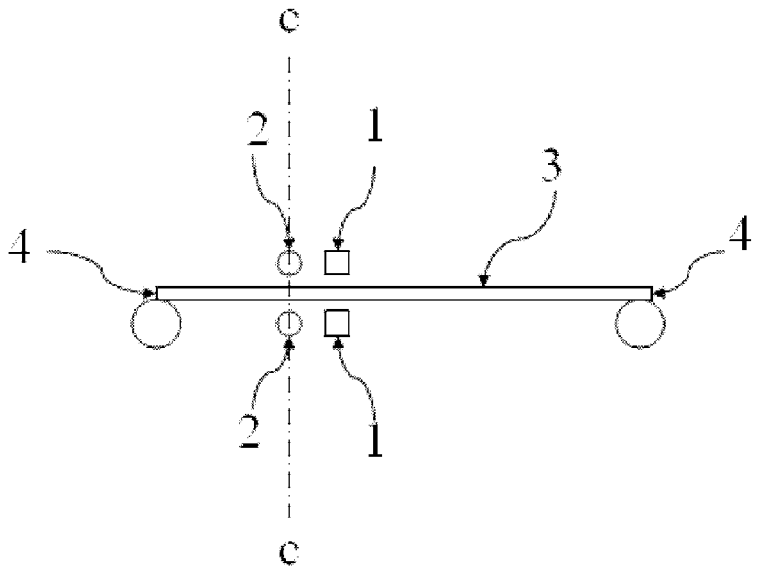
FIG. 2 shows the same arrangement of sensors and actuators as FIG. 1, but from the side of the strip.

FIG. 2 shows the same arrangement of sensors and actuators as FIG. 1, but from the side of the strip 3. The short side 4 of the strip is fixed by for example resting the strip on rollers. Between the fixed sides 4 the metal strip is suspended and is free to move. Position sensors 2 and actuators 1 are placed on both sides of the metal strip 3. The line c-c is where the strip profile is determined.

Figure 3:
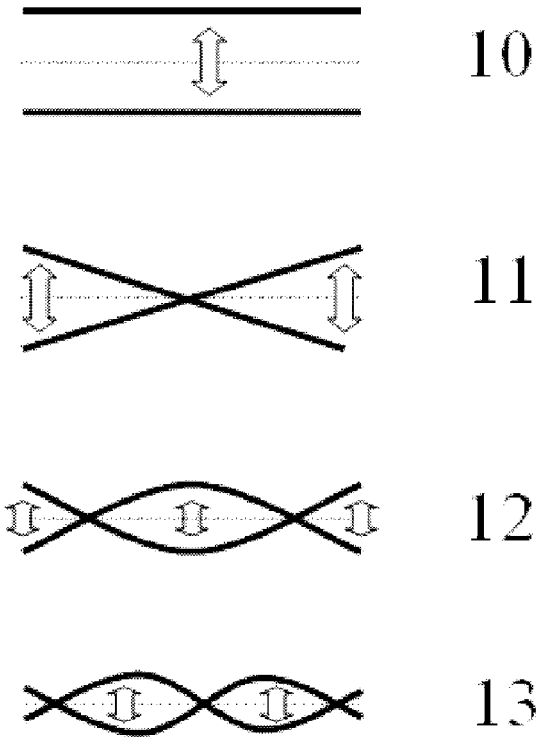
FIG. 3 shows the first natural mode shape of the metal strip profile.

FIG. 3 shows the first natural mode shape of the metal strip 3 profile. 10 show the 0-mode movement. The dotted line is a center line and the metal strip profile (black line) moves back and forth over the center line. 11 shows the 1-mode movement, where the metal strip twists back and forth over the (dotted) center line. 12 shows the 2-mode movement, where the metal strip bends back and forth over the (dotted) center line. 13 shows the 3-mode movement, where the metal strip, bent twice, moves back and forth over the (dotted) center line. The list of natural modes can be continued further.

The physics governing the dynamics of a suspended strip 3, gives that the movements of the strip profile can be expressed as a linear combination of a (in theory infinite) number of natural modes or natural vibrations or natural mode shapes of vibration. The term "natural" meaning that a movement totally restricted to a single mode is possible. The first four natural modes are shown in FIG. 3.

Figure 4:
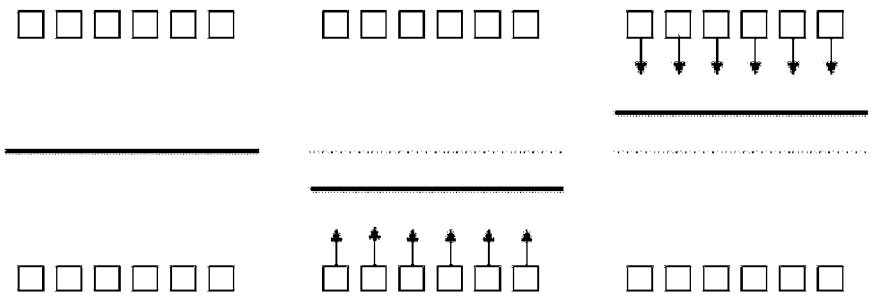
FIG. 4 shows the forces from the actuators when the strip is in 0-mode movement.

FIG. 4 shows the forces from the actuators when the strip is in 0-mode movement. The actuators controlling the strip 3 movements are small squares above and below the strip. In the left figure the metal strip 3 is in the "center" position or the wanted position (the dotted line). In the center figure, the metal strip 3 is "below" the center position (vertically displaced) and the arrows symbolize the forces from the actuators (schematically summarized forces from actuators "above" and actuators "below") on the strip 3. In the right figure, the metal strip 3 is "above" the center position and the arrows symbolize the forces from the actuators on the strip 3. The arrows also represent a best actuator response for this particular shape.

Figure 5:
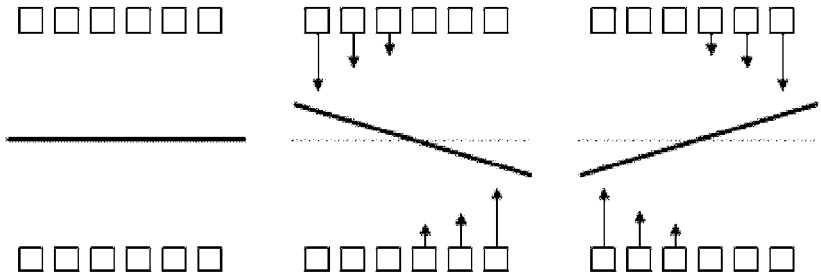
FIG. 5 shows the forces from the actuators when the strip is in 1-mode movement.

FIG. 5 shows the forces from the actuators when the strip is in 1-mode movement. The actuators controlling the strip 3 movements are small squares above and below the strip. In the left figure the metal strip 3 is in the "center" position or the wanted position (the dotted line). In the center figure, the metal strip 3 is "twisted" around center position and the arrows symbolize the forces from the actuators on the strip 3. In the right figure, the metal strip 3 is "twisted" in the other direction.

Figure 6:
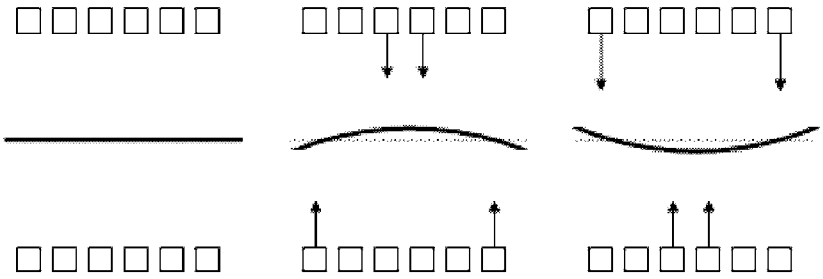
FIG. 6 shows the forces from the actuators when the strip is in 2-mode movement.

FIG. 6 shows the forces from the actuators when the strip is in 2-mode movement. In the left figure the metal strip 3 is in the "center" position. In the center figure, the metal strip 3 is bending in one direction and the arrows symbolize the forces from the actuators on the strip 3. In the right figure, the metal strip 3 is bending in the other direction.

Figure 7:
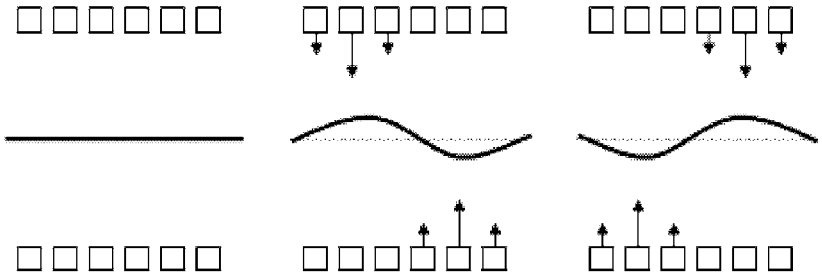
FIG. 7 shows the forces from the actuators when the strip is in 3-mode movement.

FIG. 7 shows the forces from the actuators when the strip is in 3-mode movement. In the left figure the metal strip 3 is in the "center" position. In the center figure, the metal strip 3 is in 3-mode movement and the arrows symbolize the forces from the actuators on the strip 3. In the right figure, the metal strip 3 is in 3-mode movement in other direction.

Figure 8:
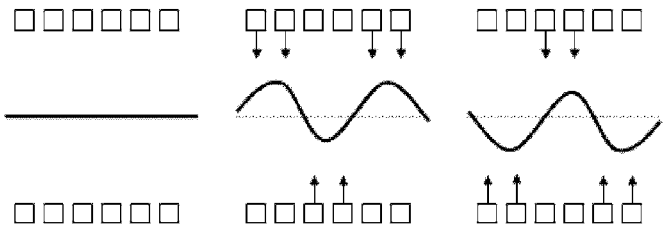
FIG. 8 shows the forces from the actuators when the strip is in 4-mode movement.

FIG. 8 shows the forces from the actuators when the strip is in 4-mode movement. In the left figure the metal strip 3 is in the "center" position. In the center figure, the metal strip 3 is in 4-mode movement. In the right figure, the metal strip 3 is in the opposite 4-mode movement. FIG. 4-8 shows different natural mode shapes but the invention is not restricted to using natural mode shapes.

Figure 9:
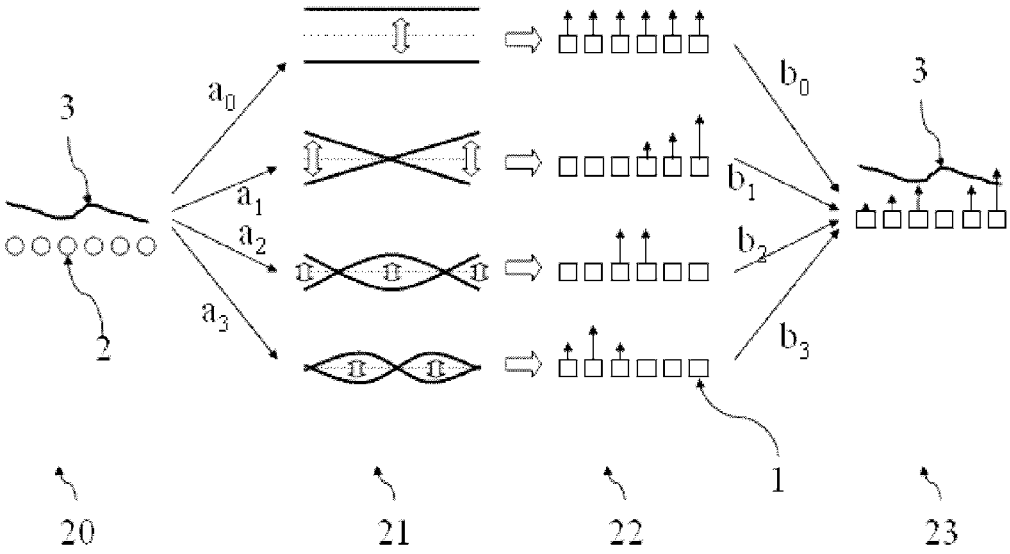
FIG. 9 shows a schematic view of decomposition method in the present invention.

FIG. 9 shows a schematic view of decomposition method in the present invention. The left FIG. 20 shows a schematic view of the moving strip 3 and the position sensors 2. The measured movements are decomposed into natural mode shape 21.

The coefficients ($a_0$, $a_1$, $a_2$, $a_3$) that describe the contribution from each natural mode shape are also determined in the decomposition. The coefficients ($a_0$, $a_1$, $a_2$, $a_3$) are time variable.

For each natural mode shape and strip there is a best actuator 22 response (only one row actuators shown). The best actuator response for a mode shape can be determined and programmed beforehand. The best actuator response for a mode depends on strip dimensions (free length, width and thickness), strip tension and strip speed. By using a combination (linear or other combination) of the best actuator response for each mode shape and using the filtered value of the determined coefficients ($a_0$, $a_1$, $a_2$, $a_3$) arrive to the best actuator response combination coefficients ($b_0$, $b_1$, $b_2$, $b_3$) and get the actual actuator response 23.

The idea behind the invention is to express both the strip profile and the total force profile as combinations (linear or other combinations) of the base shapes, using the same number of bases as there are actuators.

For each base shape, a controller is designed that uses the coefficient of that shape in the series expansion of the current profile (with the profile being approximated using available sensors) as actual value, and the coefficient for the same shape in the series expansion of the force profile as manipulated value. The available actuators are then used to synthesize the wanted profile.

As the shapes are the natural modes of the strip, a force profile that fits exactly one of the shapes should produce a movement restricted to the same shape, meaning that the controllers for each shape will be decoupled from each other, significantly simplifying the task of tuning the parameters of the controllers. The present invention is not limited in using natural mode shapes, any type of mode shape (non-natural modes) can be used to decompose the measured strip shape. These non-natural mode shapes can be associated with a best actuator 22 response (force profile) in the same way as natural mode shapes are. The combination (linear or other combination) of the force profile for any mode (natural or non-natural) is then combined to an actual actuator response 23.

The aim of the invention is to decompose the strip control into independent one-loop controls, (one for each mode shape. The one-loop controls are decoupled from each other and then combined into an actual actuator response 23.

Figure 10:
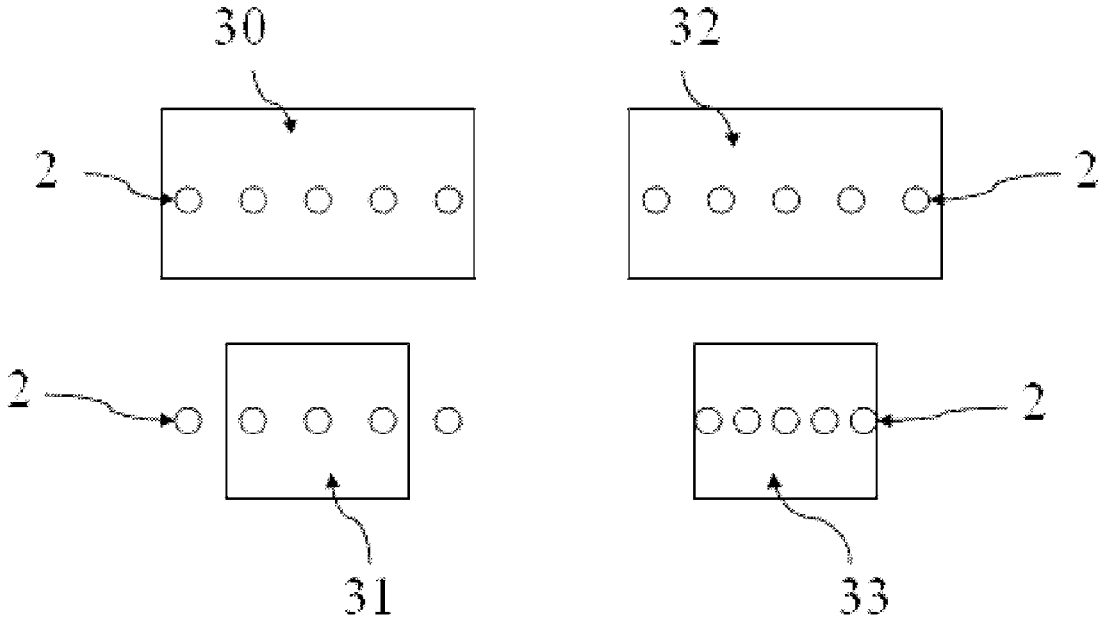
FIG. 10 shows a schematic view of adapting the sensor positions for different strip widths.

FIG. 10 shows a schematic view of adapting the sensor 2 positions for different strip widths. For wide strips 30, 32 the sensors are placed along the whole width of the strips. For less wide strips 31, 33 if the placement of sensors 2 are not adapted to strip width, some will not be able to measure the strip distance 31 and the result will be less exact determining of the strip profile and performance of the damping of the strip. If the placement of sensors 2 is adapted to strip width 33, all sensors 2 will be able to measure the strip distance. Another embodiment is to allow the placement or positions of the non-contact actuators to also adapt to the strip width. The positions of sensors could also be placed to avoid measuring the distance at zero deflection of all the different natural modes e.g. avoid having a sensor at the middle of the width of the strip for 1-mode.

What is claimed is:

1. A method for vibration damping and shape control of a suspended metal strip during continuous transport in a processing facility in a steel rolling line or surface treating line in a steel mill, comprising the steps of:

measuring distance to the strip by a plurality of non-contact sensors, the non-contact sensors being arranged across the strip and on both sides of the strip, generating a strip profile from distance measurements, decomposing the strip profile to a combination of mode shapes, determining coefficients for the contribution from each mode shape to the total strip profile, and controlling the strip profile by a plurality of non-contact actuators based on a combination of mode shapes, wherein the plurality of non-contact actuators are arranged across the strip and on both sides of the strip.

2. The method of claim 1, further comprising the step of controlling a plurality of actuators with control means adapted with preprogrammed control functions, comprising one best control function for each mode shape, wherein the plurality of actuators is controlled by weighing the preprogrammed control functions with the coefficients determined for the contribution from each mode shape to the total strip profile.

3. The method of claim 1, wherein said mode shapes are natural mode shapes.

4. The method of claim 1, wherein said strip profile is decomposed to a linear combination of mode shapes.

5. The method of claim 2, further comprising adapting the weighing of preprogrammed control functions based on input from at least one process parameter.

6. The method of claim 1, wherein the method is based on using the same number of non-contact sensors as the number of non-contact actuators.

7. The method of claim 1, wherein the method is based on using more non-contact sensors than non-contact actuators.

8. The method of claim 1, wherein the placement of the non-contact sensors are the same for all strip widths.

9. The method of claim 1, further comprising adapting the placement of the non-contact sensors to the strip width.

10. The method of claim 3, further comprising analyzing the coefficients from the decomposition of the natural mode shapes.

11. The method of claim 3, further comprising continuously carrying out a frequency analysis of the coefficients from the decomposition of the natural mode shapes to determine the frequency and size of strip movements.

12. The method of claim 11, further comprising analyzing the coefficients from the decomposition of the natural mode shapes to determine the relative energy in different mode movements of the natural mode shapes.

13. The method of claim 1, further comprising using the actuators to minimize the variance of the coefficients for the contribution from each of the mode shapes to the total strip profile.

14. The method of claim 1, further comprising using the actuators to influence a shape of the average strip profile.

15. The method of claim 5, wherein the at least one process parameter is strip width, strip thickness, strip tension and/or strip speed.

* * * * *